US007914423B1

(12) United States Patent
Cogan

(10) Patent No.: US 7,914,423 B1
(45) Date of Patent: Mar. 29, 2011

(54) ATHLETIC STRIKING APPARATUS

(76) Inventor: Michael P. Cogan, Camarillo, CA (US)

( * ) Notice: Subject to any disclaimer, the term of this patent is extended or adjusted under 35 U.S.C. 154(b) by 0 days.

(21) Appl. No.: 12/144,429

(22) Filed: Jun. 23, 2008

(51) Int. Cl.
*A63B 69/22* (2006.01)
*A63B 69/20* (2006.01)

(52) U.S. Cl. ..... 482/90; 482/86

(58) Field of Classification Search ..... 482/83–90; 473/418–420; 273/392–393
See application file for complete search history.

(56) References Cited

U.S. PATENT DOCUMENTS 4,084,811 A 4/1978 Kyo
4,309,029 A 1/1982 Tomko
4,373,733 A 2/1983 Smith, Jr.
4,421,110 A 12/1983 DeLisle et al.
4,434,980 A 3/1984 Babineaux
4,486,016 A 12/1984 Rubin
4,557,477 A 12/1985 Clements et al.
4,635,929 A 1/1987 Shustack
4,662,630 A * 5/1987 Dignard et al. ..... 482/83
4,702,472 A 10/1987 Anquetil
4,725,058 A 2/1988 Molitor
4,807,871 A 2/1989 Bryson
4,836,533 A 6/1989 Dong
4,903,966 A 2/1990 Liao
4,932,652 A 6/1990 Beall, III
4,946,159 A 8/1990 Jones
5,183,450 A 2/1993 Stelmach
5,207,407 A 5/1993 Fitzsimmons et al.
5,248,140 A 9/1993 Mower et al.
5,263,912 A 11/1993 Stelmach
5,281,191 A 1/1994 DeSousa
5,330,403 A 7/1994 Kuo
5,377,976 A 1/1995 Matherne et al.
5,437,590 A 8/1995 D'Alto
5,460,353 A 10/1995 Rittenhouse
5,470,304 A 11/1995 Decanto
5,498,001 A 3/1996 Franks et al.
5,556,088 A 9/1996 Mower et al.
5,624,358 A 4/1997 Hestilow
5,674,157 A * 10/1997 Wilkinson ..... 482/83
5,676,378 A 10/1997 West
5,702,327 A * 12/1997 Fullbright ..... 482/83
5,722,920 A * 3/1998 Bauer ..... 482/83
5,762,311 A 6/1998 Triglia
5,792,032 A 8/1998 Williams et al.
5,800,319 A 9/1998 Choate
5,816,579 A 10/1998 Broussard et al.
5,902,217 A 5/1999 Schechner et al.
5,941,801 A 8/1999 D'Alto
5,971,398 A 10/1999 Broussard et al.
5,984,842 A * 11/1999 Chu ..... 482/83
6,063,011 A 5/2000 Pelchat
6,077,204 A * 6/2000 Dickinson, Jr. ..... 482/83
6,080,089 A 6/2000 Nicholson
(Continued)

*Primary Examiner* — Fenn C Mathew
(74) *Attorney, Agent, or Firm* — Daniel P. Dooley; Fellers, Snider, et al.

(57) ABSTRACT

An athletic striking apparatus that includes at least an impact member supported by a base. The preferred embodiment further includes a plurality of predetermined angular settings provided by the base. The impact member preferably oscillates in one of at least two distinct predetermined frequencies. In accordance with the preferred embodiments, a method of using an athletic striking apparatus that includes at least the steps of providing an impact member supported by a base. A step of striking the impact member supported by the base preferably follows the providing step. The base further preferably provides a plurality of predetermined angular settings for the impact member. Also in an alternative preferred embodiment, the impact member oscillates in at least two distinct predetermined frequencies in response to an impact.

10 Claims, 5 Drawing Sheets

U.S. PATENT DOCUMENTS

| | | | | |
|---|---|---|---|---|
| 6,110,079 | A | 8/2000 | Luedke et al. | |
| 6,183,399 | B1 | 2/2001 | Chen | |
| 6,302,831 | B1 * | 10/2001 | Henry | 482/83 |
| 6,390,958 | B1 | 5/2002 | Chu | |
| 6,398,697 | B1 * | 6/2002 | Nichols, Jr. | 482/87 |
| 6,786,854 | B1 * | 9/2004 | Hsu | 482/83 |
| 7,086,997 | B1 * | 8/2006 | Fields et al. | 482/90 |
| 2006/0270529 | A1 * | 11/2006 | Fields et al. | 482/83 |

* cited by examiner

FIG. 4
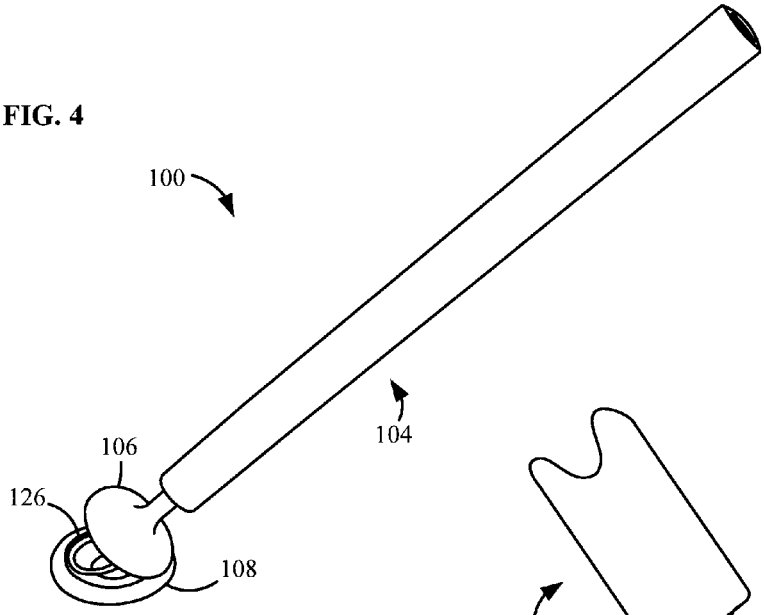
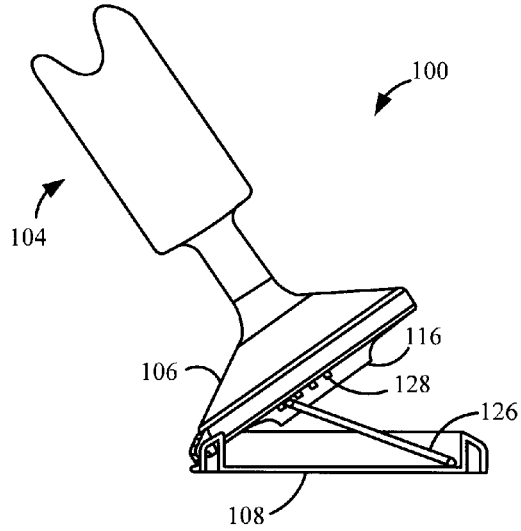
FIG. 5
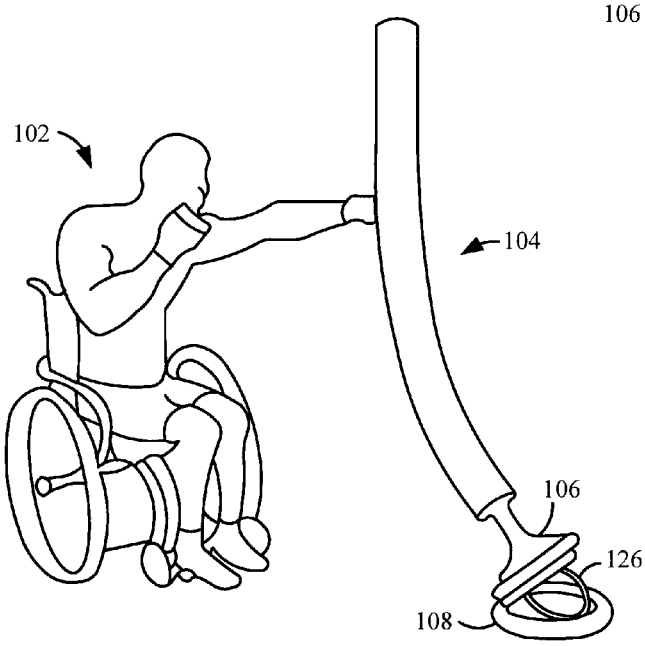
FIG. 6

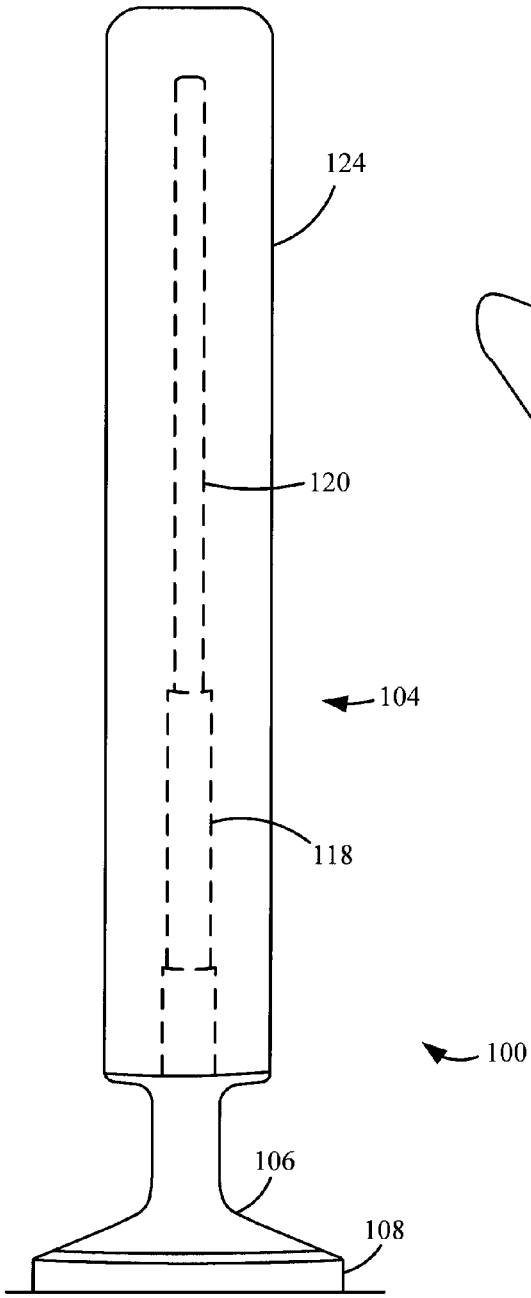
FIG. 7
FIG. 8
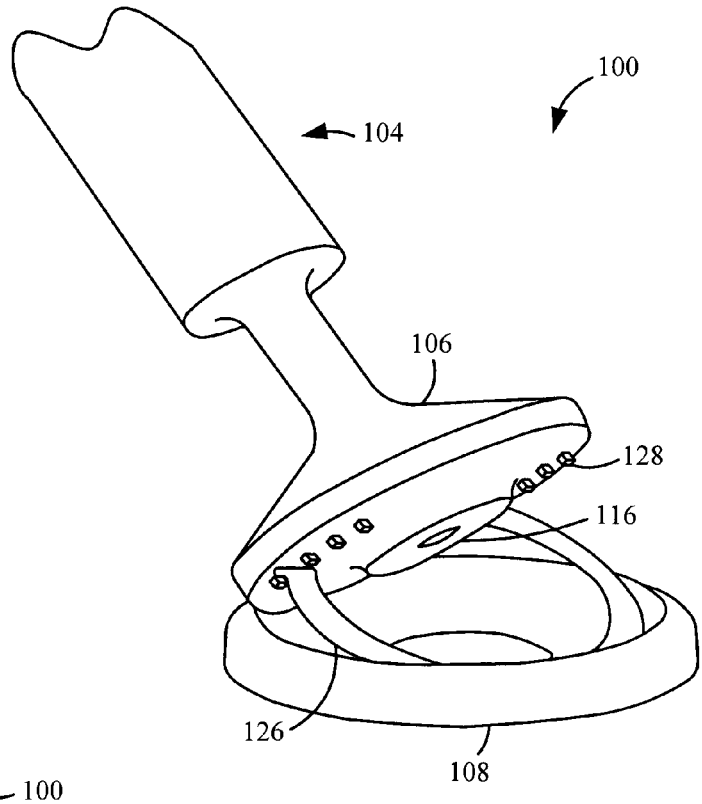

ATHLETIC STRIKING APPARATUS

FIELD OF THE INVENTION

The present invention relates generally to athletic equipment, but not by way of limitation, to the field of sports and fitness training.

BACKGROUND OF THE INVENTION

The ability to efficiently undertake a variety of sports and fitness exercises with a single piece of athletic equipment has been a goal of the fitness industry for years.

Historically, numerous separate pieces of equipment were needed to conduct certain sports and fitness exercises. While the separate pieces of equipment are functional, the added space needed to store the equipment in conjunction with the inconvenience of frequently moving to a new piece of equipment hinders the effectiveness of sport and fitness training.

Accordingly, there is a continuing need for improved equipment and methods.

SUMMARY OF THE INVENTION

In accordance with the preferred embodiments, an athletic striking apparatus that includes at least an impact member is provided. The impact member is preferably supported by a base that provides a plurality of predetermined angular settings for the impact member. In a preferred embodiment, the impact member oscillates in one of at least two distinct predetermined frequencies in response to an impact.

Preferably, the present inventive athletic striking apparatus includes at least the steps of providing an impact member supported by a base that includes a plurality of predetermined angular settings, placing the base adjacent to a base anchor, wherein the base anchor provides an angular control member capable of communicating with a select one of the predetermined angular settings, to present the impact member at a predetermined angle with respect to the base anchor, and striking the impact member supported by the base to induce at least one of two distinct predetermined frequencies of oscillation.

These and various other features and advantages which characterize the claimed invention will be apparent from reading the following detailed description and a review of the associated drawings.

BRIEF DESCRIPTION OF THE DRAWINGS

FIG. 4 is an elevation view of the athletic striking apparatus in an alternate preferred embodiment;

FIG. 5 is a partial cross-section view of a portion of the athletic striking apparatus in an alternate preferred embodiment;

FIG. 6 is a view in perspective of the athletic striking apparatus in an alternate preferred embodiment;

FIG. 7 is a side view of the athletic striking apparatus in a preferred embodiment;

FIG. 8 is an elevation view of the athletic striking apparatus in an alternate preferred embodiment.

DETAILED DESCRIPTION OF THE INVENTION

Figure 1:
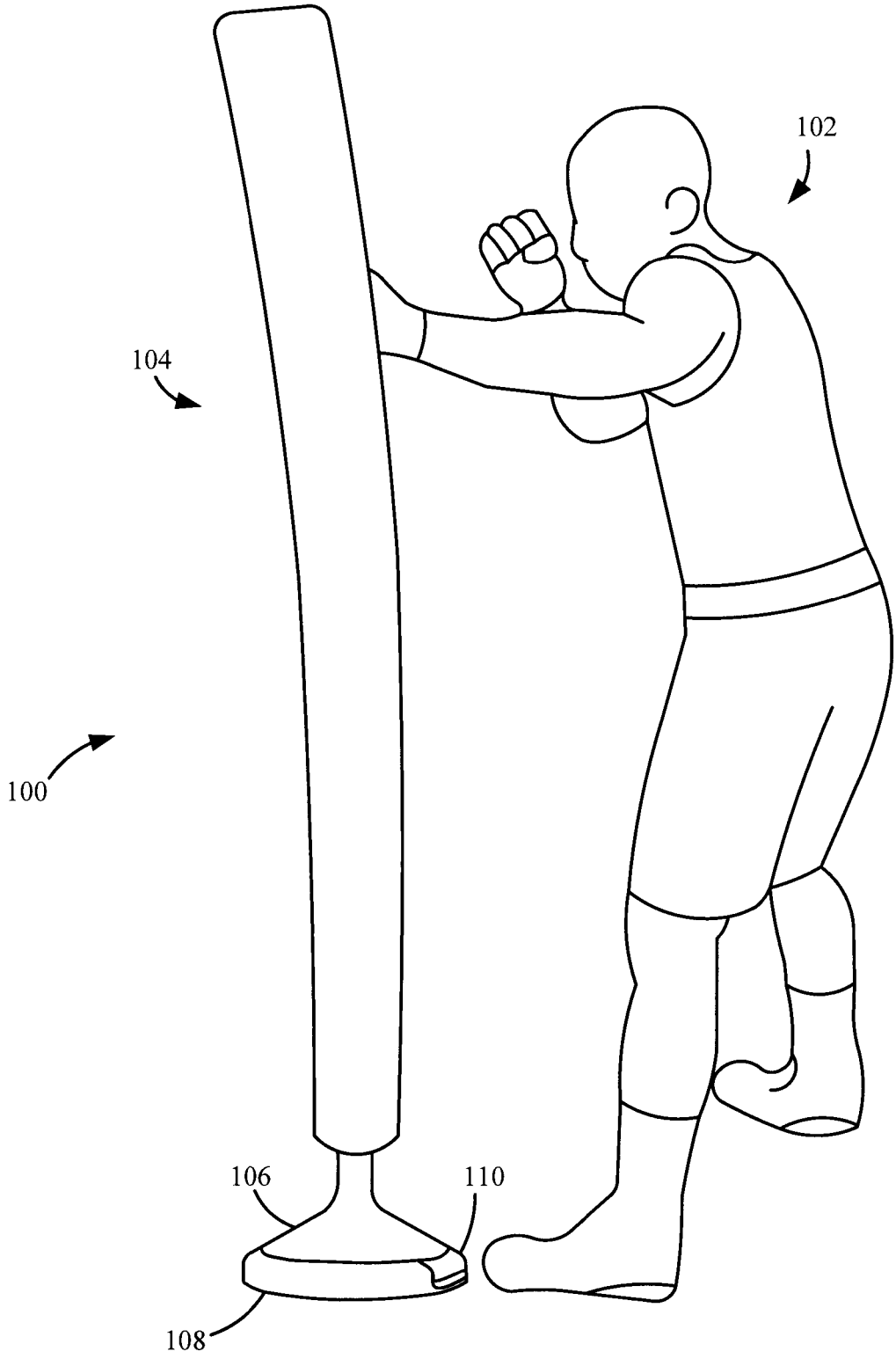
FIG. 1 is a view in perspective of the athletic striking apparatus in a preferred embodiment.

Preferred embodiments of the present invention are generally directed to an athletic striking apparatus configured to facilitate sports and fitness training. Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For example, features illustrated or described as part of one embodiment, can be used on another embodiment to yield a still further embodiment. Thus, it is intended that the present invention cover such modifications and variations as come within the scope of the appended claims and their equivalents. Additionally, the numbering of components in the drawings is consistent throughout the application, with the same components having the same number in each of the drawings.

FIG. 1 shows a preferred embodiment of the athletic striking apparatus 100 preferably includes an impact member 104, which can be engaged by a user 102. Preferably, the impact member 104 is supported by a base 106. Further in a preferred embodiment, the base 106 is secured adjacent to a base anchor 108 with a selectable latch 110. The base 106 in conjunction with the base anchor 108 preferably allows the user 102 to reasonably strike the athletic striking apparatus 100 without knocking it over. Likewise, the low center of gravity provided by the securement of the base 106 to the base anchor 108 allows a user 102 to strike the impact member 104 in a variety of locations without tipping the apparatus 100 over.

Figure 2:
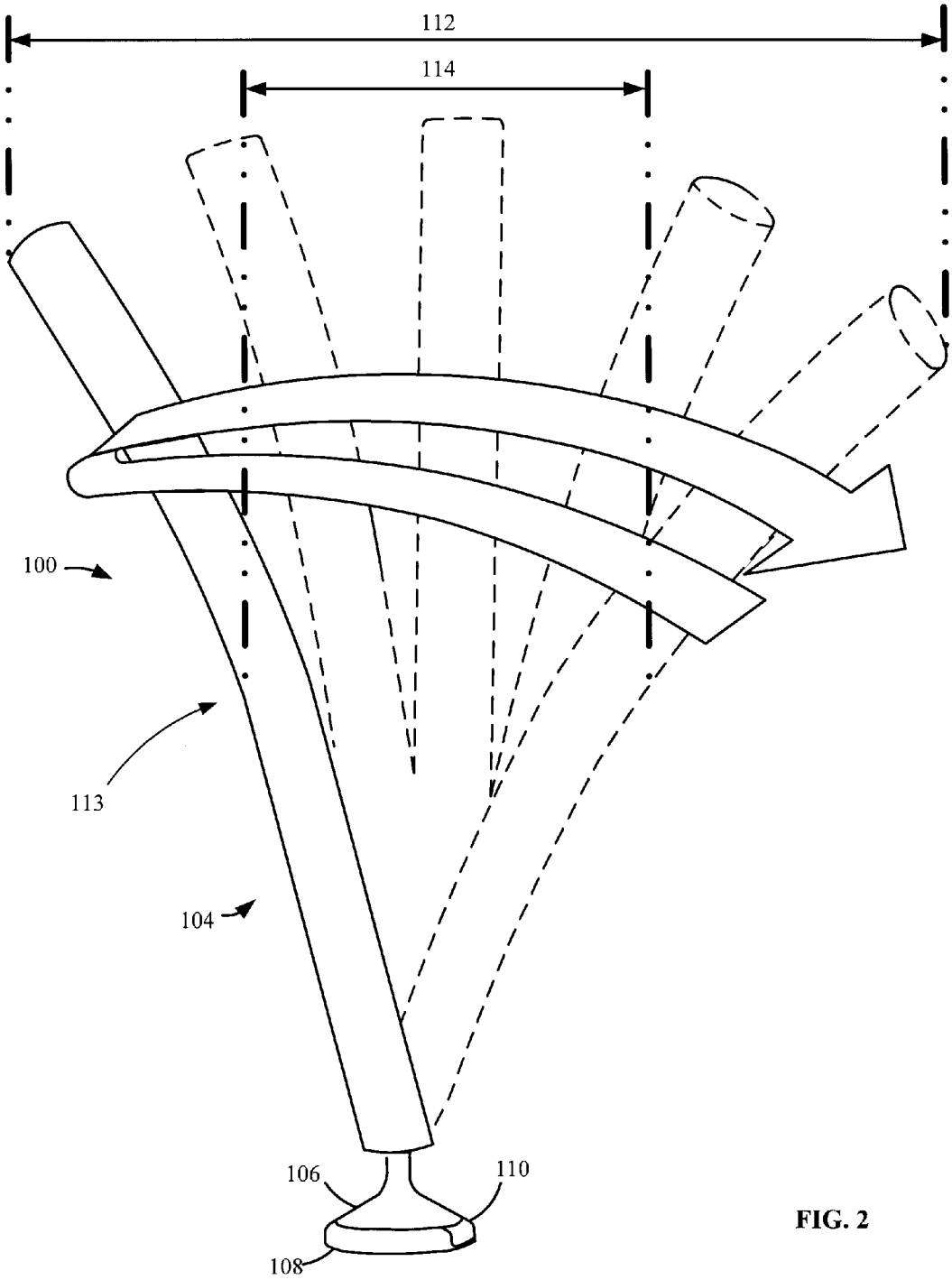
FIG. 2 is a side view of the operation of the athletic striking apparatus in a preferred embodiment.

FIG. 2 displays a side view showing a preferred reaction of the athletic striking apparatus 100 to an impact. The athletic striking apparatus 100 preferably includes an impact member 104 and base 106 secured adjacent the base anchor 108 by a latch 110. Further in a preferred embodiment, the impact member 104 will react to an impact by oscillating in one of at least two distinct frequencies. One skilled in the art will easily understand that the frequency of the impact member 104 means the number of times the member 104 transverses a midpoint. The preferred two distinct frequencies result in a range of motion that is greater for some portions of the impact member 104 than others. A greater range of motion 112 preferably occurs when the impact member 104 oscillates at the lower of two predetermined frequencies. Conversely, a lesser range of motion 114 preferably occurs when the impact member 104 oscillates at the higher of two predetermined frequencies. Sign number 113 identifies the junction of the disparate ranges of motion 112 and 114.

Figure 3:
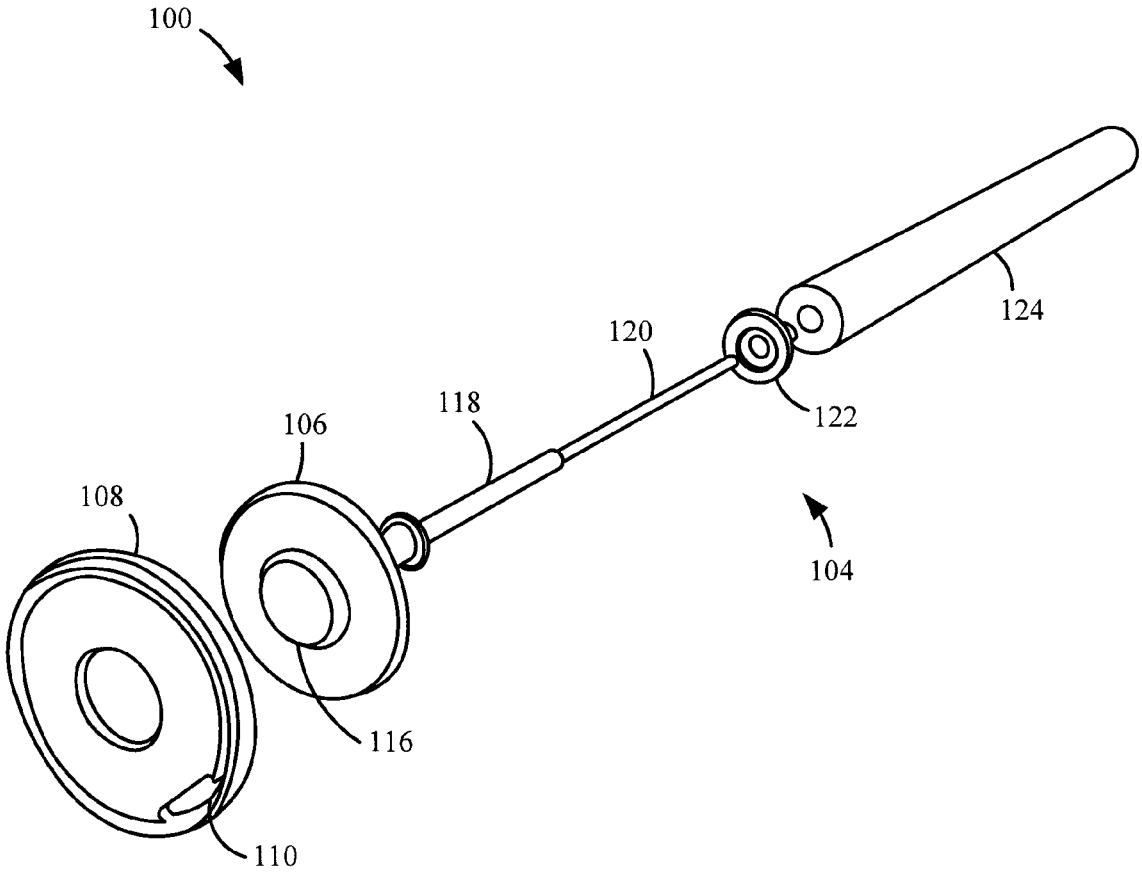
FIG. 3 is an exploded isometric view of the athletic striking apparatus in a preferred embodiment.

The illustration of FIG. 3 shows an exploded isometric view of the athletic striking apparatus 100 in a preferred embodiment. The base is preferably displayed with a raised portion 116 to facilitate a single oscillating frequency when an excess of a threshold amount of force is applied to the impact member 104. When the base 106 is not secured to the base anchor 108, the raised portion 116 will preferably maintain a vertical presentation of the impact member 104 when force below a predetermined threshold is applied. However, an application of force to the impact member 104 above a predetermined threshold will preferably result in a single oscillating frequency. Further in a preferred embodiment, the base 106 comprises a mass that allows the base 106 and impact member 104 to self-right after force is applied to the impact member 104. Likewise, the base 106 consistently maintains a free standing vertical position due in part to the preferred embodiment of the base 106.

Preferably, the impact member 104 comprises a first oscillation member 118 connected to a second oscillation member 120 of smaller diameter. While the oscillation members 118 and 120 function to dampen an impact, an alternate preferred embodiment includes the first oscillation member 118 having a larger diameter than the second oscillation member 120. Furthermore, the oscillation members 118 and 120 can be composed of similar or dissimilar materials, including but not limited to spring metal, titanium-nickel alloys, composite polymers, graphite impregnated polymers, and alternate materials selected to allow distinct predetermined oscillation frequencies for each of the oscillation members 118 and 120. In a preferred embodiment, the oscillation members 118 and 120 operate to dissipate force applied to the impact member 104 through oscillating at distinct frequencies. Moreover, the predetermined oscillating frequencies are preferably configured to be the resonant frequencies of each oscillation member 118 and 120 to most efficiently dissipate energy transferred to the impact member 104. Therefore, each oscillation member 118 and 120 will attain a distinct oscillation frequency to efficiently dampen energy transferred to the impact member 104.

Further in a preferred embodiment, the impact member 104 comprises a connection member 122 configured to maintain a connection between the base 106 and a unitary padded cover 124. The unitary padded cover 124 is preferably constructed of an energy absorbing material such as, but not limited to, polymers, rubber, fabric, and other textiles. In an alternate preferred embodiment, the unitary padded cover 124 is composed of various materials strategically placed on the impact member 104. Similarly, an alternate preferred embodiment has the unitary padded cover 124 having separate portions that can be manipulated to present unique obstacles for a user 102 (of FIG. 1).

FIG. 4 displays an elevation view of the athletic striking apparatus 100 in an alternate preferred embodiment. The preferred base anchor 108 is shown providing an angular control member 126 that supports the base 106 and impact member 104 in an angular position with respect to the anchor base 108. Further in an alternate preferred embodiment, the angular control member 126 can be configured in a multitude of angular positions to support the base 106 and impact member 104. The base 106 is preferably configured to maintain the impact member 104 in a free standing angular position after force is applied. That is, the angular control member 126 supports the base 106 and impact member 104 allowing the impact member 104 to oscillate in at least one of two predetermined frequencies as a result of impact. Likewise, the base 106 is preferably maintained in a selected angular position after force is applied to the impact member 104.

FIG. 5 shows a partial cross-section view of a portion of the athletic striking apparatus 100 in an alternate preferred embodiment. The base anchor 108 preferably provides the angular control member 126 in supporting relation to the base 106 by interacting with one or more angular settings 128. In an alternate preferred embodiment, the angular control member 126 engages the angular settings 128 in two areas of the base 106. However, one skilled in the art would understand that the angular control member 126 can support the base 106 in fewer or more numerous locations without deviation from the current embodiment. Similarly, the angular settings 128 are preferably notches located adjacent to the raised portion 116 of the base 106, but can comprise extrusions, depressions, and attachment means such as magnets, hook and loop, and buttons.

FIG. 6 displays a view in perspective of the athletic striking apparatus 100 in an alternate preferred embodiment. The anchor base 108 is shown providing the angular control member 126 that supports the base 106 in an angular position with respect to the anchor base 108. The capability of positioning the impact member 104 preferably includes an angular position that is conducive to a user 102 applying force to the impact member 104 from a seated position. Similarly, the angular position of the base 106 can manipulated to facilitate efficient low height exercises such as, but not limited to, kicking and kneeing. In an alternate preferred embodiment, the impact member 104 will oscillate at one distinct predetermined frequency in response to an impact while being configured in an angular position.

FIG. 7 shows a side plan view of the athletic striking apparatus 100 in a preferred embodiment. The base anchor 108 is preferably illustrated adjacent to the base 106. The preferred embodiment of the impact member 104 includes at least a first oscillation member 118 and a second oscillation member 120. The diameter of the first oscillation member 118 is preferably less than the diameter of the second oscillation member 120. However, the diameters can be substantially the same or be configured with the second oscillation member 120 having a greater diameter than the first oscillation member 118 in an alternate preferred embodiment. Further, the first oscillation member 118 has a length less than the second oscillation member 120 in a preferred embodiment. In contrast, alternate preferred embodiments comprise the first oscillation member 118 and second oscillation member 120 being substantially the same or the first oscillation member 118 having a length greater than that of the second oscillation member 120. FIG. 7 further shows that in a preferred embodiment, the impact member 104 includes at least the unitary padded cover 124 enclosing the first and second oscillation members (118, 120).

FIG. 8 illustrates an elevation view of the athletic striking apparatus 100 in an alternate preferred embodiment. The base anchor 108 is shown preferably providing the angular control member 126 that supports the base 106 through its interaction with the angular settings 128. In a preferred embodiment, the angular settings 128 are located on opposite sides of the raised portion 116 of the base 106 providing at least two engagement areas for the angular control member 126 to support the base 106. However, other alternate preferred embodiments can include greater or fewer numbers of angular settings 128 in various areas on the base 106 for support. Furthermore, the angular control member 126 can be configured to engage the base 106 at a number of locations greater or less than two in alternate preferred embodiments.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. An athletic striking apparatus comprising:

a spring free impact member;

a base supporting the impact member, the base providing a plurality of predetermined angular settings for said impact member, in which the impact member includes at least first and second oscillation members which simultaneously oscillate in at least two distinct predetermined frequencies in response to an impact, and wherein the impact member contactingly engages and is vertically centered about the base, when the impact member is not in use, and further wherein said impact member includes at least a unitary padded cover enclosing said first and second oscillation members.

2. The apparatus of claim 1, in which said impact member responds to the impact at a predetermined lower frequency of oscillation at a proximal end than at a distal end.

3. The apparatus of claim 1, in which said base assures the impact member consistently attains a free standing vertical position.

4. The apparatus of claim 1, in which said impact member comprises first and second oscillation members, and in which said first oscillation member oscillates at a range of motion distinct from a range of motion of said second oscillation member in response to an impact imparted upon said impact member.

5. The apparatus of claim 1, further comprising a base anchor providing an angular control member communicating with a select one of the predetermined angular settings to present the impact member at a predetermined angle in respect to the base anchor.

6. The apparatus of claim 5, in which said base remains in a predetermined angular setting in response to an impact.

7. The apparatus of claim 5, in which said base anchor retains the base in each selected predetermined angular setting.

8. The apparatus of claim 5, in which the base anchor further comprises a latch that maintains the base adjacent to the base anchor, when the latch is in a closed position.

9. The apparatus of claim 3, in which the base further provides a mass, wherein the mass assures the impact member consistently attains a free standing vertical position.

10. The apparatus of claim 1, in which the base further provides a raised portion facilitating a single oscillation frequency when an impact force greater than a predetermined force threshold is applied to the impact member.

* * * * *